US009110491B2

(12) United States Patent
May

(10) Patent No.: US 9,110,491 B2
(45) Date of Patent: Aug. 18, 2015

(54) STOP MECHANISM FOR REGULATING THE FLOW OF GAS TO A GAS GRILLING APPLIANCE AND METHOD OF REGULATING

(75) Inventor: Randy May, Dallas, TX (US)

(73) Assignee: The Brinkmann Corporation, Dallas, TX (US)

( * ) Notice: Subject to any disclaimer, the term of this patent is extended or adjusted under 35 U.S.C. 154(b) by 1536 days.

(21) Appl. No.: 12/537,827

(22) Filed: Aug. 7, 2009

(65) Prior Publication Data

US 2011/0030501 A1 Feb. 10, 2011

Related U.S. Application Data

(60) Provisional application No. 61/087,561, filed on Aug. 8, 2008.

(51) Int. Cl.

| | |
|---|---|
| ***F23N 1/00*** | (2006.01) |
| ***G05G 5/04*** | (2006.01) |
| ***F24C 3/12*** | (2006.01) |
| ***G05G 1/10*** | (2006.01) |
| *F23D 14/00* | (2006.01) |
| *F23D 14/02* | (2006.01) |
| *F23D 14/04* | (2006.01) |

(52) U.S. Cl.

CPC *G05G 5/04* (2013.01); *F24C 3/126* (2013.01); *G05G 1/10* (2013.01); *Y10T 74/20636* (2015.01)

(58) Field of Classification Search

CPC ..... G01F 15/001; G01F 15/002; F16K 5/10; F16K 5/103; F16K 3/32; G05G 5/04; G05G 1/10; G24C 3/126; Y10T 74/20636

USPC ..... 126/25 R, 39 N, 42; 137/269, 270; 251/92, 93, 60, 284, 285

IPC ..... F23N 1/00,3/02; F23D 14/00, 14/02, F23D 14/04

See application file for complete search history.

(56) References Cited

U.S. PATENT DOCUMENTS

| | | | | | |
|---|---|---|---|---|---|
| 1,822,794 | A | * | 9/1931 | Antrim | 126/42 |
| 2,160,358 | A | * | 5/1939 | Harper et al. | 251/297 |
| 2,250,356 | A | * | 7/1941 | Brumbaugh | 251/96 |
| 2,540,056 | A | * | 1/1951 | William | 251/286 |
| 2,626,160 | A | * | 1/1953 | Brumbaugh | 137/614.17 |
| 2,650,610 | A | * | 9/1953 | Brumbaugh | 137/637 |
| 2,650,612 | A | * | 9/1953 | Brumbaugh | 137/637.4 |
| 2,650,613 | A | * | 9/1953 | Brumbaugh | 137/637.4 |
| 2,699,125 | A | | 1/1955 | Scott | |
| 2,750,997 | A | | 6/1956 | Reuter | |
| 2,893,426 | A | * | 7/1959 | Brumbaugh | 137/614.17 |
| 3,001,547 | A | * | 9/1961 | Brumbaugh | 137/614.17 |
| 3,068,902 | A | * | 12/1962 | Brumbaugh | 137/628 |

(Continued)

*Primary Examiner* — Steven B McAllister
*Assistant Examiner* — Daniel E Namay
(74) *Attorney, Agent, or Firm* — Sheppard, Mullin, Richter & Hampton LLP

(57) ABSTRACT

The present invention is embodied in a conversion kit for a gas grilling appliance with rotary valves that avoids the need to use either a sleeve inserted in the inner chamber of the regulating plug or interchangeable knobs on the valve shaft. The conversion kit comprises a regulating device for each valve that can be readily installed by removing the existing control knob, placing the regulating device on the valve shaft, and replacing the control knob. The regulating device cooperates with a stop structure on the control panel to limit rotation of the control knob, when converting the grilling appliance from one type of gas to another.

24 Claims, 4 Drawing Sheets

(56) References Cited

U.S. PATENT DOCUMENTS

| | | | | | |
|---|---|---|---|---|---|
| 3,188,881 | A | * | 6/1965 | Pusch | 74/504 |
| 3,198,923 | A | * | 8/1965 | Tripp | 200/308 |
| 3,528,640 | A | * | 9/1970 | Smith | 251/285 |
| 3,537,473 | A | * | 11/1970 | Dezurik, Jr. | 137/556.6 |
| 3,575,542 | A | * | 4/1971 | Branson et al. | 431/58 |
| 3,682,451 | A | | 8/1972 | Vosper | |
| 3,739,989 | A | | 6/1973 | Vosper | |
| 4,089,347 | A | * | 5/1978 | Christo | 137/625.41 |
| 4,499,630 | A | * | 2/1985 | Harris et al. | 16/441 |
| 4,718,448 | A | | 1/1988 | Love et al. | |
| 4,981,156 | A | * | 1/1991 | Nicklas et al. | 137/270 |
| 4,995,423 | A | * | 2/1991 | McHugh | 137/559 |
| 5,009,393 | A | | 4/1991 | Massey | |
| 5,014,528 | A | * | 5/1991 | Roberts | 70/177 |
| 5,104,013 | A | | 4/1992 | Hawley | |
| 5,205,275 | A | * | 4/1993 | Chang | 126/39 N |
| 5,259,589 | A | * | 11/1993 | Posner | 251/285 |
| 5,332,161 | A | | 7/1994 | Schweitzer et al. | |
| 5,345,838 | A | * | 9/1994 | Howie, Jr. | 74/553 |
| 5,622,083 | A | * | 4/1997 | Kirimoto et al. | 74/473.21 |
| 5,692,536 | A | * | 12/1997 | Tokarz | 137/270 |
| 5,931,150 | A | * | 8/1999 | Bowen et al. | 126/42 |
| 6,331,108 | B1 | | 12/2001 | Stiner | |
| RE37,617 | E | * | 4/2002 | Sherman | 137/557 |
| 6,394,081 | B1 | * | 5/2002 | Aguirre-Esponda et al. | 126/42 |
| 6,446,935 | B1 | * | 9/2002 | Winkler | 251/315.1 |
| 6,520,481 | B2 | | 2/2003 | Harneit | |
| 6,640,390 | B1 | * | 11/2003 | Lai | 16/441 |
| 6,758,242 | B2 | * | 7/2004 | Jones et al. | 137/625.41 |
| 6,796,544 | B1 | * | 9/2004 | Chen | 251/205 |
| 7,021,335 | B2 | * | 4/2006 | Yang | 137/625.41 |
| 7,156,370 | B2 | | 1/2007 | Albizuri | |
| 7,967,005 | B2 | * | 6/2011 | Parrish | 126/42 |
| 8,282,390 | B2 | * | 10/2012 | Albizuri | 431/12 |
| 2003/0178072 | A1 | * | 9/2003 | Jones et al. | 137/625.17 |
| 2003/0192116 | A1 | * | 10/2003 | Burger et al. | 4/695 |
| 2005/0167530 | A1 | | 8/2005 | Ward et al. | |
| 2005/0202361 | A1 | | 9/2005 | Albizuri | |
| 2006/0060251 | A1 | * | 3/2006 | Gamard et al. | 137/613 |
| 2006/0175566 | A1 | * | 8/2006 | Albizuri | 251/207 |
| 2006/0201496 | A1 | | 9/2006 | Shingler | |
| 2008/0138749 | A1 | | 6/2008 | Albizuri | |
| 2008/0202496 | A1 | | 8/2008 | Albizuri | |
| 2008/0289615 | A1 | | 11/2008 | Parrish | |
| 2010/0089385 | A1 | * | 4/2010 | Albizuri | 126/39 R |
| 2011/0005508 | A1 | * | 1/2011 | Albizuri | 126/39 E |
| 2011/0030501 | A1 | * | 2/2011 | May | 74/527 |
| 2012/0031391 | A1 | * | 2/2012 | Albizuri | 126/39 BA |
| 2012/0073560 | A1 | * | 3/2012 | Parrish | 126/25 R |
| 2012/0073562 | A1 | * | 3/2012 | Albizuri | 126/39 E |

* cited by examiner

STOP MECHANISM FOR REGULATING THE FLOW OF GAS TO A GAS GRILLING APPLIANCE AND METHOD OF REGULATING

CROSS-REFERENCE TO RELATED APPLICATION

Priority is claimed to U.S. Provisional Application Ser. No. 61/087,561 filed on Aug. 8, 2008, the contents of which are incorporated by reference in their entirety.

FIELD OF THE INVENTION

The present invention relates to a stop mechanism for regulating the flow of gas to a gas grilling appliance and a method of regulating.

BACKGROUND OF THE INVENTION

Gas grilling appliances commonly have rotary valves mounted on the front control panel of the appliance. Each rotary valve has an actuating shaft that passes through the front control panel into the interior of the appliance. The actuating shaft extends inside a hollow valve body located within the appliance and connected to a gas inlet conduit. The external end of the actuating shaft is fitted with a rotary control knob. The rotary control knob may be removed from the actuating shaft by pulling the knob away from the shaft.

The valve body also has a gas outlet conduit connected to a burner. The gas outlet conduit has an injector nozzle comprising a calibrated discharge orifice chosen according to the type of gas to be supplied to the burner, e.g., liquid propane gas ("LPG") or natural gas ("NG"). The injector nozzle may be spaced apart from the burner inlet by a small distance to allow air to mix with the gas to create a combustible mixture as the gas is fed into the burner. Alternatively, the injector nozzle may extend into the burner inlet, with air entering the burner through holes in burner.

An example of such a rotary valve is disclosed in U.S. Pat. No. 6,520,481. In this patent, the rotary valve has an actuating shaft coupled to a frusto-conical regulating plug or valve plug. The plug is configured to pivot through a 270-degree angle to supply gas at varying rates of flow to the burner.

In this type of rotary valve, the actuating shaft or control knob has a pin that limits the angular travel of the shaft. The pin is guided by a groove cut in the valve body or in the front control panel. The groove limits the angular travel of the actuating shaft or control knob, and thus the angular travel of the regulating plug. As the pin moves within the groove, the plug pivots, exposing an opening in the plug of varying cross-section to the gas inlet conduit and thus regulating the flow of gas from the inlet conduit to the burner.

Like the discharge orifice, the opening in the regulating plug is calibrated for a particular type of gas, e.g., LPG or NG. This presents a challenge when a user wants to convert the gas grilling appliance from one type of gas to another. While it is relatively easy to replace the injector nozzle or to mount an additional injector nozzle on the gas outlet conduit, as is described in U.S. Patent Application Publication No. 2008/0138749, changing the calibration of the opening in the regulating plug for different gases is more complicated.

For example, in U.S. Pat. No. 5,009,393, a sleeve is inserted in the inner chamber of the regulating plug. The area of the opening in the regulating plug is adjusted by rotating the sleeve, thus modifying the uncovered area of the opening. This solution suffers from the disadvantage that, to rotate the sleeve, the user has to transmit a precise turn to the sleeve using a tool that the user has to insert in an opening in the actuating shaft.

In U.S. Patent Application Publication No. 2008/0138749, the grilling appliance has a plurality of rotary valves, each of which includes a pair of interchangeable control knobs. An integral lug is formed on the back side of one of the interchangeable control knobs of each pair of knobs, facing the control panel, for use with NG ("the NG control knob"); the other one of the interchangeable control knobs, for use with LPG, does not have such a lug ("the LPG control knob"). When the NG control knob is placed on the valve shaft, the integral lug is received in an arcuate slide groove that is formed in the control panel around the opening for the valve shaft. One end of the slide groove functions as a stop for the integral lug on the NG control knob and, hence, limits the rotation of the NG control knob. Since the LPG control knob lacks such a lug, its rotation is limited only by the valve itself. The user chooses the control knob based upon the type of gas to be used. Although this solution avoids the need to use a tool as in U.S. Pat. No. 5,009,393 discussed above, it suffers from the disadvantage that, to convert a grilling appliance from one type of gas to another, the user purchase and install a whole new set of control knobs, which can be costly and wasteful.

Accordingly, there is a need for a conversion kit for a gas grilling appliance having rotary valves, the conversion kit comprising a regulating device configured to allow a user to convert the appliance from one type of gas to another while avoiding the problems discussed above. The present invention satisfies this and other needs, and provides further related advantages.

SUMMARY OF THE INVENTION

The present invention is embodied in a conversion kit for a gas grilling appliance with rotary valves that avoids the need to use either a sleeve inserted in the inner chamber of the regulating plug or interchangeable knobs on the valve shaft. The conversion kit comprises a regulating device for each valve that can be readily installed by removing the existing control knob, placing the regulating device on the valve shaft, and replacing the control knob. The regulating device cooperates with a stop structure on the control panel to limit rotation of the control knob, when converting the grilling appliance from one type of gas to another.

More specifically, the present invention comprises a stop mechanism for regulating the flow of gas to a gas grilling appliance having a control panel and a rotary valve, wherein the rotary valve has an actuating shaft, an external end of which extends through the control panel for mounting a control knob. The stop mechanism comprises a stop structure attached to the control panel and spaced laterally from the valve shaft, and a stop plate adapted to be received on the valve shaft between the control panel and the control knob. The stop plate has an opening that is keyed to the valve shaft so that the stop plate rotates with it, a first portion having a radial extent that clears the stop structure when rotating, and a second portion having a radial extent that engages the stop structure when rotating to limit the rotation of the control knob.

In a presently preferred embodiment, the stop plate is a relatively thin and substantially planar structure. The first portion of the stop plate is an arcuate section having a radius less than the distance from the center of the valve shaft to the stop structure. The second portion of the stop plate is an arcuate section having a radius greater than the distance from the center of the valve shaft to the stop structure. The juncture of the first and second sections of the stop plate defines a shoulder that engages the stop structure to limit rotation of the control knob.

In one embodiment, the stop pin or like structure is not attached directly to the control panel, but is instead attached to a bezel adapted to be mounted on the control panel surrounding the external end of the valve shaft.

Other features and advantages of the invention will become apparent from the following detailed description of the preferred embodiments taken with the accompanying drawings, which illustrate, by way of example, the principles of the invention.

DETAILED DESCRIPTION OF THE PREFERRED EMBODIMENTS

Figure 1:
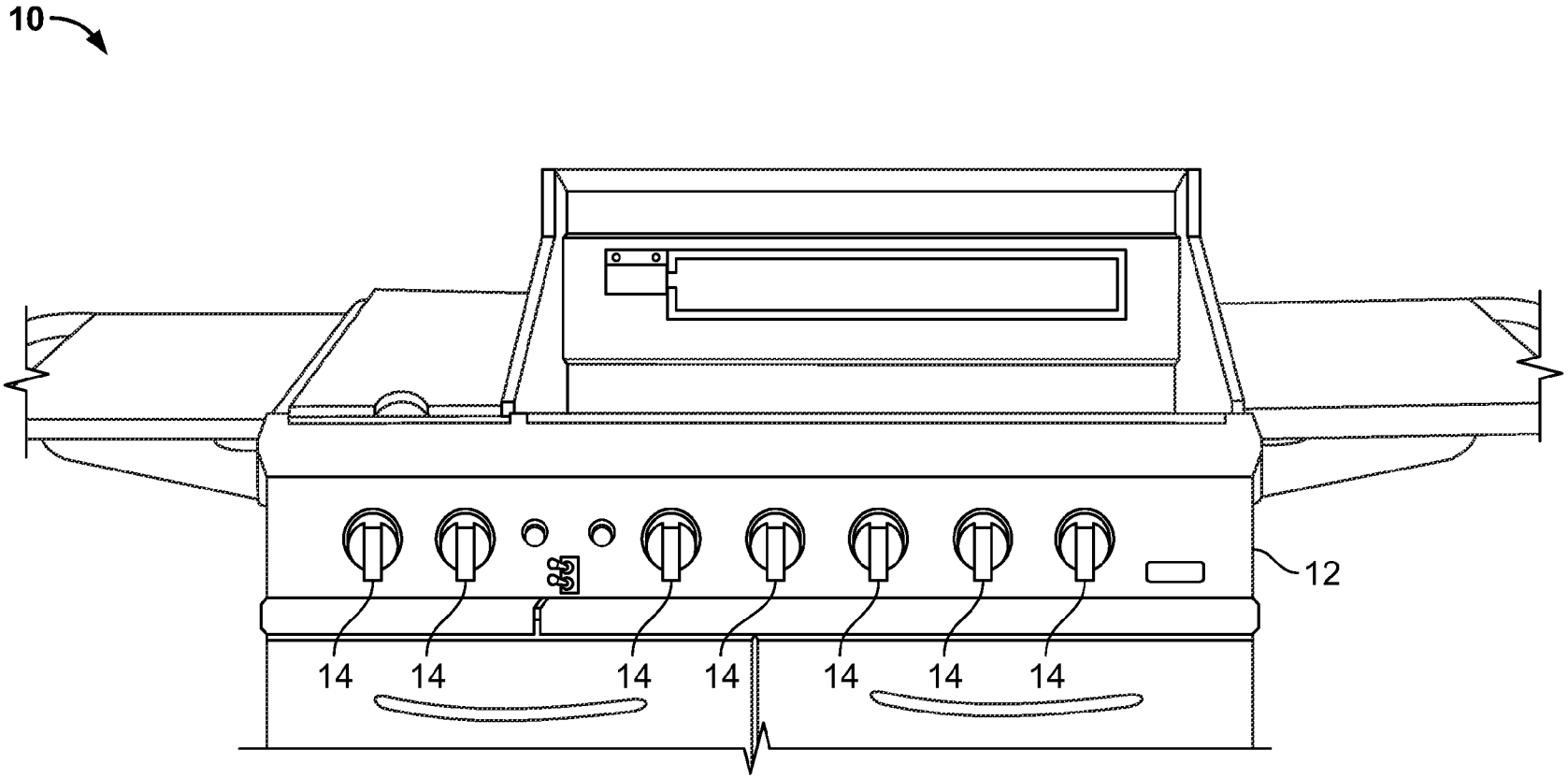
FIG. 1 is a perspective view of a gas grilling appliance, in accordance with an embodiment of the present invention.

Referring now to the drawings, and particularly to FIG. 1 thereof, there is shown a perspective view of a gas grilling appliance 10, in accordance with an embodiment of the present invention. The gas grilling appliance has a front control panel 12 comprising a plurality of rotary control knobs 14 to control the flow of gas to the burners. The gas grilling appliance also has a plurality of rotary valves, each rotary valve having an actuating shaft 16 (FIG. 3) that rotates in response to the rotation of its associated rotary control knob.

Figure 2:
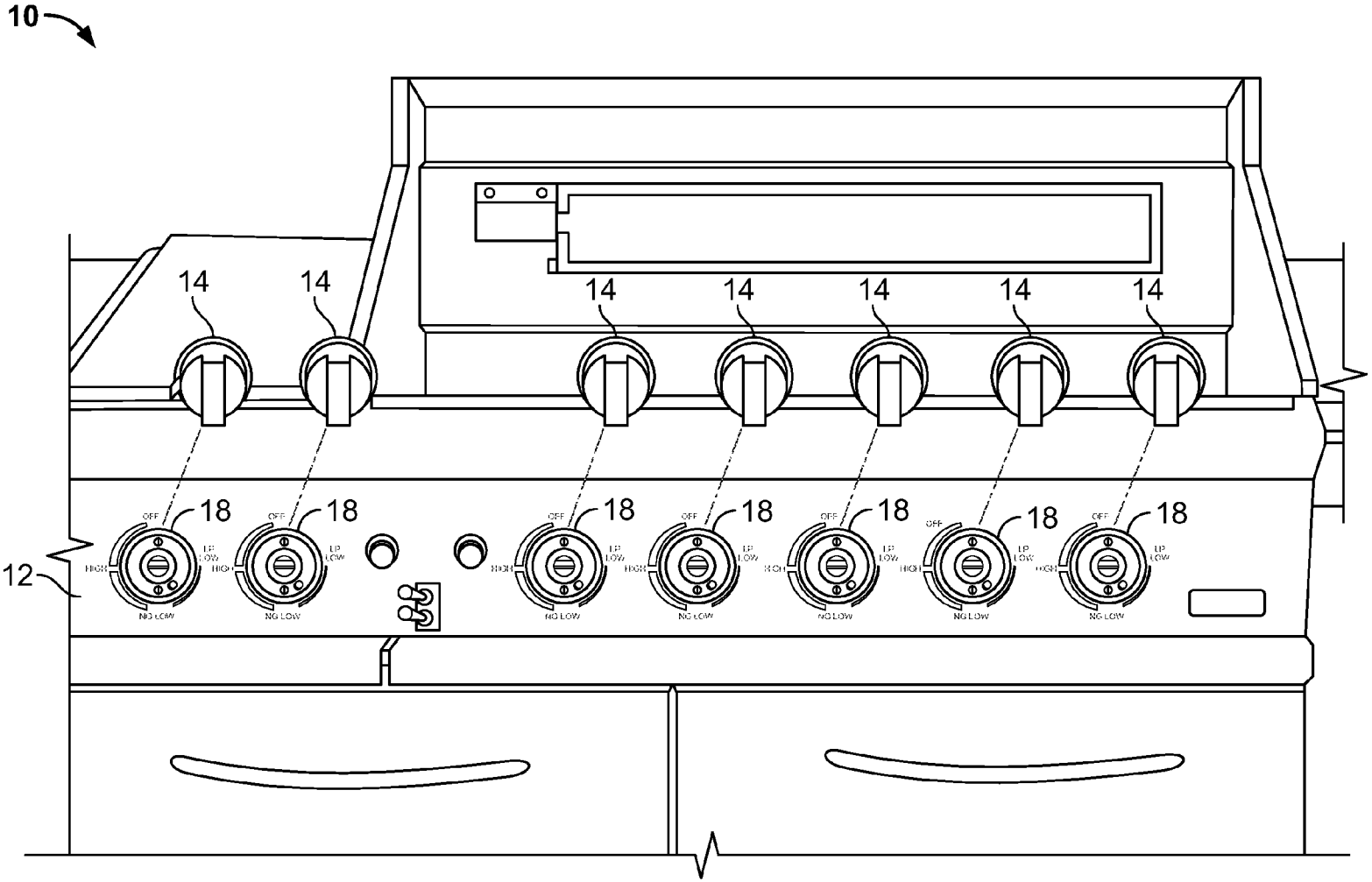
FIG. 2 is a perspective view of a gas grilling appliance with its rotary control knobs removed, in accordance with an embodiment of the present invention.

FIG. 2 shows a perspective view of the gas grilling appliance 10 with the rotary control knobs 14 removed from the front control panel 12, in accordance with an embodiment of the present invention. With the rotary control knobs removed, a plurality of bezels 18, each of which surrounds the external end of a rotary valve actuating shaft 16, are exposed.

Figure 3:
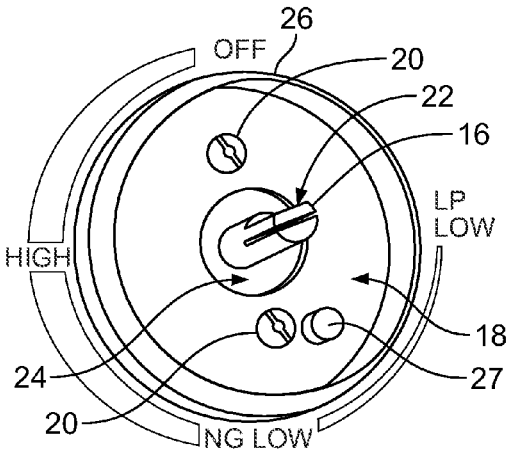
FIG. 3 is a perspective view of an actuating shaft external end and bezel, in accordance with an embodiment of the present invention.
Figure 4:
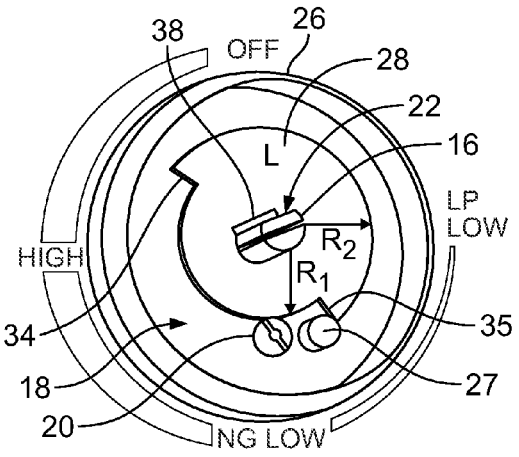
FIG. 4 is a perspective view of an actuating shaft external end and bezel, the actuating shaft external end fitted with a stop plate, in accordance with an embodiment of the present invention.

With reference to FIGS. 3 and 4, there is shown a perspective view of an actuating shaft external end 16 and bezel 18, in accordance with the preferred embodiment of the invention. The actuating shaft external end has a generally semicircular or D-shaped cross-section, with a straight edge 22 along one side to engage a corresponding semicircular or D-shaped receptacle in a rotary control knob 14. Each bezel is generally ring-shaped and is attached to the front control panel by screws 20. Each bezel has a generally circular center hole or opening 24 that is sized and configured to allow the actuating shaft external end to pass through the bezel. The bezel also has an outer rim 26. The bezel may additionally have markings (e.g., "off," "high," "NG low" and "LP low") to guide the user in turning the rotary control knob.

Also shown in FIG. 3, the bezel includes a stop pin 27, radially spaced from the opening 24 for the actuating shaft external end 16 of the valve. The stop pin cooperates with a stop plate 28 (FIG. 4) in accordance with the present invention to limit rotation of the control knob 18, as will now be described. The stop pin may be integrally formed on the bezel or separately attached by any suitable means such as a screw or the like.

The stop plate 28 is shown in FIG. 4, received on the actuating shaft external end 16 of the valve for converting the grilling appliance from using LPG to using NG. The stop plate has a center hole or opening 30 that is sized and configured to allow the actuating shaft external end to pass through the stop plate. The center hole 30 is generally semicircular or D-shaped, having a straight edge 32 to engage the straight edge 22 of the actuating shaft external end 16 so that the stop plate is keyed to the valve shaft for rotation with it. The stop plate is relatively thin, substantially planar and made of metal.

The stop plate 28 has a first portion of radius $R_1$ that is less than the distance from the center of the opening 24 in bezel 18 to the stop pin 27 to provide rotational clearance between the stop plate and the stop pin. The stop plate has a second portion of radius $R_2$ that is greater than the distance from the center of the opening 24 in bezel 18 to the stop pin 27. A radially extending shoulder 34 is formed on the stop plate at the juncture of the first and second portion that engages the stop pin to limit or stop the control knob 14 when rotated counter-clockwise (facing the grilling appliance). This stop defines the maximum setting or rotation of the control knob when using NG. When the stop plate is removed for use of the grilling appliance with LPG, the maximum setting or rotation of the control knob is determined solely by the valve itself. There is sufficient clearance between the stop pin and the control knob so that the stop pin does not interfere with the control knob's rotation in the absence of the stop plate.

As shown in FIG. 4, the stop plate 28 includes a second shoulder 35 as a consequence of the differing radii $R_1$ and $R_2$ of the two portions of the stop plate. However, this second shoulder need not take any particular form because it is not designed to engage the stop pin 27 during counter-clockwise rotation of the control knob 14. Rather the "off" or minimum setting of the control knob is determined by the valve itself, regardless of whether LPG or NG is used with the grilling appliance. The only requirement is that the second shoulder (in whatever form) not interfere with the counter-clockwise rotation of the control knob, i.e., that there is clearance between the second shoulder and the stop pin when the valve is rotated to its "off" or minimum setting.

From the foregoing discussion, it will be appreciated that the precise shape of the first and second portions of the stop plate 28 is immaterial, so long as the first portion has a radial extent that clears the stop pin 27 on the bezel 18 then rotating, and the second portion has a radial extent that engages the stop pin on the bezel when rotating to limit the rotation of the control knob 14.

To install the stop plate 28 onto an actuating shaft external end 16, the user first removes a rotary control knob 14 from the front control panel 12. The user then installs the stop plate 28 onto the actuating shaft external end 16 as shown in FIG. 4. The stop plate has a tab and marking (e.g., "L") to guide the user in installing the stop plate 28 onto the actuating shaft external end 16 with the correct side of the stop plate 28 facing outward. The user then installs the rotary control knob 14 back onto the actuating shaft external end 16, over the stop plate 28.

It will be appreciated that the stop plate 28 can be installed onto the actuating shaft external end 16 when NG is used and removed when LPG is used. A single, all-purpose rotary control knob can thus be used, regardless of whether the gas grilling apparatus is configured to use NG or LPG.

Figure 5:
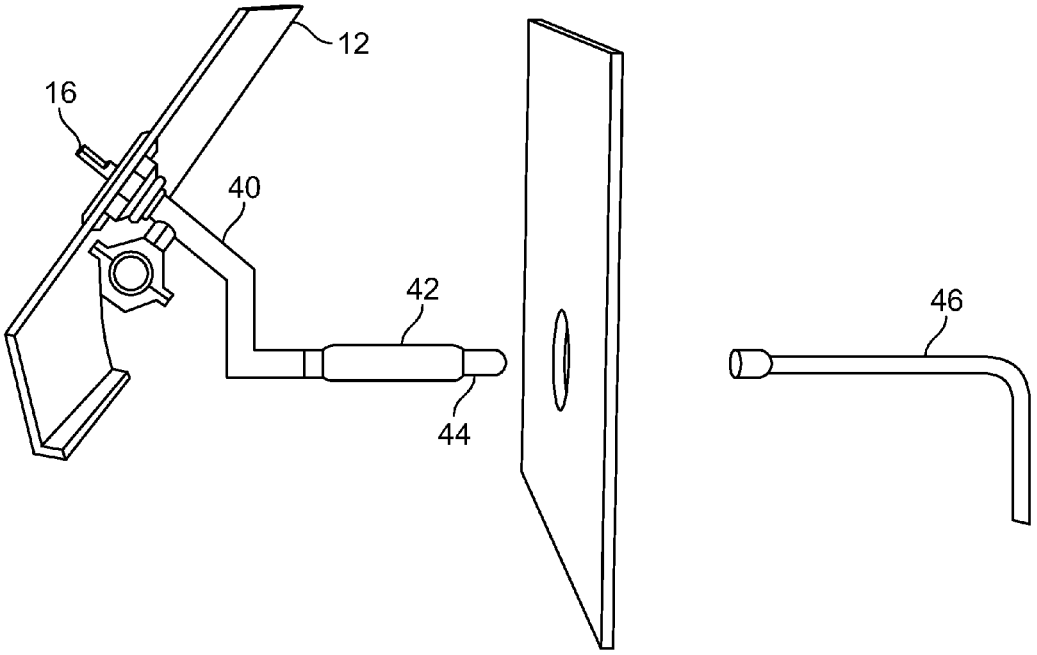
FIG. 5 is a right side elevation view of a rotary valve and gas orifice tool, in accordance with an embodiment of the present invention.

With reference to FIG. 5, there is shown a right side elevation view of a rotary valve and gas orifice tool, in accordance with an embodiment of the present invention. FIG. 5 shows a rotary valve 40 attached to the front panel 12. The rotary valve 40 uses a dual nozzle approach to control the maximum flow of gas depending upon whether LPG or NG is used with the gas grilling appliance 10. As shown in FIG. 5, the rotary valve 40 has a valve outlet conduit 42, onto which a removable LP gas orifice 44 is threaded. The LP gas orifice 44 has a calibrated hole that restricts the flow of gas to the burner when LPG is used with the gas grilling appliance 10. When NG is used with the gas grilling appliance 10, the LP gas orifice 44 is removed from the valve outlet conduit 42 using the gas orifice tool 46 and is replaced with an NG gas orifice, an example of which is shown in FIG. 6B. In another embodiment, the NG gas orifice is initially attached between the LP gas orifice 44 and the valve outlet conduit 42, such that the LP gas orifice 44 may be removed from the valve outlet conduit 42 without the need to attach a new NG gas orifice. The NG gas orifice has a calibrated hole (substantially larger than the calibrated hole in the LPG gas orifice 44) that permits the maximum flow of NG at a substantially higher rate than needed for LPG.

Figure 6A:
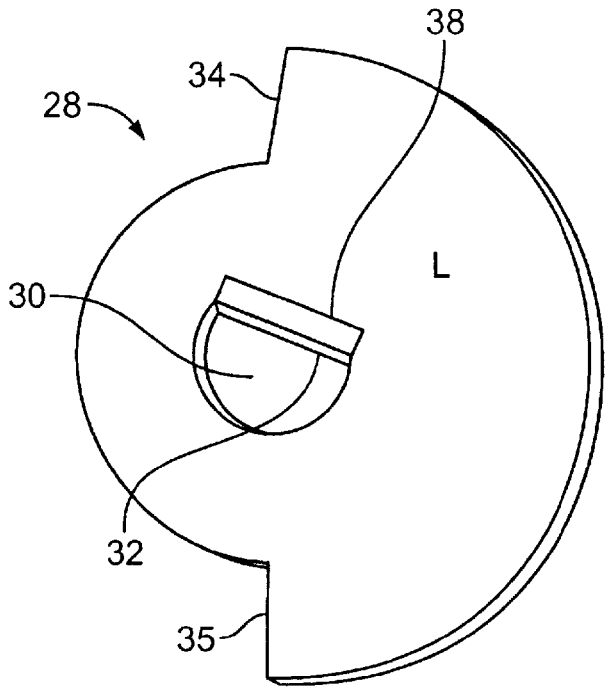
FIG. 6A is a top plan view of a stop plate, in accordance with an embodiment of the present invention.
Figure 6B:
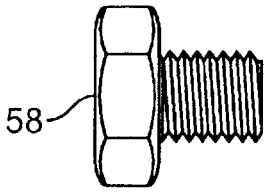
FIG. 6B is a side elevation view of a valve orifice, in accordance with an embodiment of the present invention.

With reference to FIG. 6A, there is shown a top plan view of a stop plate 28, in accordance with an embodiment of the present invention. FIG. 6B shows a valve orifice 58. The stop plate 28 can be configured in various sizes, depending upon the size of the rotary control knob to which the stop plate is to be applied. The valve orifice can also be configured in various sizes.

Figure 7:
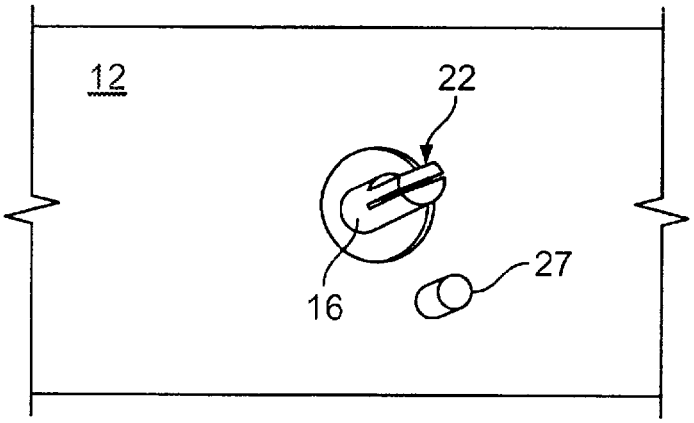
FIG. 7 is a perspective view of a control panel having a stop pin attached to the control panel, in accordance with an embodiment of the present invention.

With reference to FIG. 7, there is shown a perspective view of a control panel 12 having a stop pin 27 attached to the control panel, in accordance with an embodiment of the present invention. In this embodiment, the stop pin or like structure is not attached to a bezel, but is instead attached directly to the control panel, thus eliminating the need for a separate bezel. A stop plate 28 may be installed on the external end of the actuating shaft 16 to limit rotation of a control knob 18, as already described above.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A bezel/plate assembly for regulating the flow of gas to a gas grilling appliance having a control panel and a rotary valve, wherein the rotary valve has an actuating shaft, an external end of which extends through the control panel for mounting a control knob, the bezel/plate assembly comprising:

a bezel adapted to be mounted on the control panel surrounding the external end of the actuating shaft; and a stop plate separate from the control knob and adapted to be received on the actuating shaft between the bezel and the control knob;

wherein the bezel has a stop structure spaced laterally from the actuating shaft; and wherein the stop plate comprises an opening that is keyed to the actuating shaft so that the stop plate rotates with the actuating shaft, a first portion having a radial extent that clears the stop structure on the bezel when rotating, and a second portion having a radial extent that engages the stop structure on the bezel when rotating to limit the rotation of the control knob;

wherein the stop plate prevents the actuating shaft from rotating past a first angular position corresponding to a natural gas minimum flow rate when the stop plate is installed, and wherein removal of the stop plate permits the actuating shaft to be rotated past the first angular position to a second angular position corresponding to a liquid propane gas minimum flow rate.

2. The bezel/plate assembly of claim 1, wherein the opening in the stop plate has a straight edge to engage the actuating shaft.

3. The bezel/plate assembly of claim 1, wherein the stop structure and second portion radial extent define the maximum rotation of the control knob when natural gas is used with the gas grilling appliance.

4. The bezel/plate assembly of claim 1, wherein the bezel/plate assembly permits the gas grilling appliance to be converted from liquid propane gas to natural gas without replacement of the control knob.

5. A bezel/plate assembly for regulating the flow of gas to a gas grilling appliance having a control panel and a rotary valve, wherein the rotary valve has an actuating shaft defining a longitudinal axis and having an external end that extends through the control panel for mounting a control knob, the bezel/plate assembly comprising:

a bezel adapted to be mounted on the control panel surrounding the external end of the actuating shaft; and a stop plate separate from the control knob and adapted to be received on the actuating shaft between the bezel and the control knob;

wherein the bezel has a stop structure spaced laterally from the actuating shaft;

wherein the stop plate comprises an opening that is keyed to the actuating shaft so that the stop plate rotates with the actuating shaft, a first arcuate section having a radius less than the distance from the longitudinal axis of the actuating shaft to the stop structure on the bezel, and a second arcuate section having a radius greater than the distance from the longitudinal axis of the actuating shaft to the stop structure on the bezel;

wherein the first arcuate section and second arcuate section meet at a juncture;

wherein the juncture of the first arcuate section and second arcuate section of the stop plate defines a shoulder configured to engage the stop structure on the bezel to limit rotation of the control knob;

wherein the stop plate prevents the actuating shaft from rotating past a first angular position corresponding to a natural gas minimum flow rate when the stop plate is installed, and wherein removal of the stop plate permits the actuating shaft to be rotated past the first angular position to a second angular position corresponding to a liquid propane gas minimum flow rate.

6. The bezel/plate assembly of claim 5, wherein the opening in the stop plate has a straight edge to engage the actuating shaft.

7. The bezel/plate assembly of claim 5, wherein the stop structure and shoulder define the maximum rotation of the control knob when natural gas is used with the gas grilling appliance.

8. The bezel/plate assembly of claim 5, wherein the bezel/plate assembly permits the gas grilling appliance to be converted from liquid propane gas to natural gas without replacement of the control knob.

9. A bezel/plate assembly for regulating the flow of gas to a gas grilling appliance having a control panel and a rotary valve, wherein the rotary valve has an actuating shaft, an external end of which extends through the control panel, the bezel/plate assembly comprising:

a substantially planar stop plate comprising a hole defining an axis normal to the plane of the stop plate, a first planar section having a first outer radius extending outward from the axis, and a second planar section having a second radius greater than the first radius extending outward from the axis, wherein the hole is shaped to engage the actuating shaft external end and cause the stop plate to rotate with the actuating shaft, and wherein the second planar section defines a radially extending shoulder; and a bezel comprising a hole shaped to allow the actuating shaft external end to pass through the bezel without engaging the bezel, and stopping means extending outward from the bezel for engaging the shoulder of the stop plate and limiting the rotation of the actuating shaft;

wherein the stop plate prevents the actuating shaft from rotating past a first angular position corresponding to a natural gas minimum flow rate when the stop plate is installed, and wherein removal of the stop plate permits the actuating shaft to be rotated past the first angular position to a second angular position corresponding to a liquid propane gas minimum flow rate.

10. The bezel/plate assembly of claim 9, wherein the hole in the stop plate has a straight edge to engage the actuating shaft external end.

11. The bezel/plate assembly of claim 9, wherein the stopping means and shoulder define the maximum rotation of the actuating shaft when natural gas is used with the gas grilling appliance.

12. The bezel/plate assembly of claim 9, wherein the bezel/plate assembly permits the gas grilling appliance to be converted from liquid propane gas to natural gas without replacement of a control knob.

13. A stop mechanism for regulating the flow of gas to a gas grilling appliance having a control panel and a rotary valve, wherein the rotary valve has an actuating shaft, an external end of which extends through the control panel for mounting a control knob, the stop mechanism comprising:

a stop structure attached to the control panel and spaced laterally from the actuating shaft; and a stop plate separate from the control knob and adapted to be received on the actuating shaft between the control panel and the control knob;

wherein the stop plate comprises an opening that is keyed to the actuating shaft so that the stop plate rotates with the actuating shaft, a first portion having a radial extent that clears the stop structure when rotating, and a second portion having a radial extent that engages the stop structure when rotating to limit the rotation of the control knob, wherein the stop plate prevents the actuating shaft from rotating past a first angular position corresponding to a natural gas minimum flow rate when the stop plate is installed, and wherein removal of the stop plate permits the actuating shaft to be rotated past the first angular position to a second angular position corresponding to a liquid propane gas minimum flow rate.

14. The stop mechanism of claim 13, wherein the opening in the stop plate has a straight edge to engage the actuating shaft.

15. The stop mechanism of claim 13, wherein the stop structure and second portion radial extent define the maximum rotation of the control knob when natural gas is used with the gas grilling appliance.

16. The stop mechanism of claim 13, wherein the stop mechanism permits the gas grilling appliance to be converted from liquid propane gas to natural gas without replacement of the control knob.

17. A stop mechanism for regulating the flow of gas to a gas grilling appliance having a control panel and a rotary valve, wherein the rotary valve has an actuating shaft defining a longitudinal axis and having an external end that extends through the control panel for mounting a control knob, the stop mechanism comprising:

a stop structure attached to the control panel and spaced laterally from the actuating shaft; and a stop plate separate from the control knob and adapted to be received on the actuating shaft between the control panel and the control knob;

wherein the stop plate comprises an opening that is keyed to the actuating shaft so that the stop plate rotates with the actuating shaft, a first arcuate section having a radius less than the distance from the longitudinal axis of the actuating shaft to the stop structure, and a second arcuate section having a radius greater than the distance from the longitudinal axis of the actuating shaft to the stop structure;

wherein the first arcuate section and second arcuate section meet at a juncture;

wherein the juncture of the first arcuate section and second arcuate section of the stop plate defines a shoulder configured to engage the stop structure to limit rotation of the control knob;

wherein the stop plate prevents the actuating shaft from rotating past a first angular position corresponding to a natural gas minimum flow rate when the stop plate is installed, and wherein removal of the stop plate permits the actuating shaft to be rotated past the first angular position to a second angular position corresponding to a liquid propane gas minimum flow rate.

18. The stop mechanism of claim 17, wherein the opening in the stop plate has a straight edge to engage the actuating shaft.

19. The stop mechanism of claim 17, wherein the stop structure and shoulder define the maximum rotation of the control knob when natural gas is used with the gas grilling appliance.

20. The stop mechanism of claim 17, wherein the stop mechanism permits the gas grilling appliance to be converted from liquid propane gas to natural gas without replacement of the control knob.

21. A stop mechanism for regulating the flow of gas to a gas grilling appliance having a control panel and a rotary valve, wherein the rotary valve has an actuating shaft, an external end of which extends through the control panel, the stop mechanism comprising:

a substantially planar stop plate comprising a hole defining an axis normal to the plane of the stop plate, a first planar section having a first outer radius extending outward from the axis, and a second planar section having a second radius greater than the first radius extending outward from the axis, wherein the hole is shaped to engage the actuating shaft external end and cause the stop plate to rotate with the actuating shaft, and wherein the second planar section defines a radially extending shoulder;

and stopping means extending outward from control panel for engaging the shoulder of the stop plate and limiting the rotation of the actuating shaft;

wherein the stop plate prevents the actuating shaft from rotating past a first angular position corresponding to a natural gas minimum flow rate when the stop plate is installed, and wherein removal of the stop plate permits the actuating shaft to be rotated past the first angular position to a second angular position corresponding to a liquid propane gas minimum flow rate.

22. The stop mechanism of claim 21, wherein the hole in the stop plate has a straight edge to engage the actuating shaft external end.

23. The stop mechanism of claim 21, wherein the stopping means and shoulder define the maximum rotation of the actuating shaft when natural gas is used with the gas grilling appliance.

24. The stop mechanism of claim 21, wherein the stop mechanism permits the gas grilling appliance to be converted from liquid propane gas to natural gas without replacement of a control knob.

* * * * *